US005667147A

United States Patent [19]

Edlinger

[11] Patent Number: 5,667,147

[45] Date of Patent: Sep. 16, 1997

[54] PROCESS AND DEVICE FOR GRANULATING AND CRUSHING MOLTEN MATERIALS AND GRINDING STOCKS

[75] Inventor: Alfred Edlinger, Baden, Switzerland

[73] Assignee: Holderbank Financiere Glarus AG, Glarus, Switzerland

[21] Appl. No.: 495,650

[22] PCT Filed: Dec. 1, 1994

[86] PCT No.: PCT/AT94/00185

§ 371 Date: Aug. 31, 1995

§ 102(e) Date: Aug. 31, 1995

[87] PCT Pub. No.: WO95/15402

PCT Pub. Date: Jun. 8, 1995

[30] Foreign Application Priority Data

Dec. 3, 1993 [AT] Austria ..... 2458/93

[51] Int. Cl.[6] ..... C21B 3/08

[52] U.S. Cl. ..... 241/1; 241/20; 241/23; 241/41

[58] Field of Search ..... 241/1, 20, 23, 241/41, 301

[56] References Cited

U.S. PATENT DOCUMENTS

| | | | |
|---|---|---|---|
| 2,450,978 | 10/1948 | Meinzer . | |
| 5,441,205 | 8/1995 | Kanazumi et al. | 241/41 |

FOREIGN PATENT DOCUMENTS

| | | |
|---|---|---|
| 413903 | 1/1924 | Germany . |
| 1137048 | 9/1962 | Germany . |
| 2444197 | 3/1976 | Germany . |
| 86054 | 3/1987 | Luxembourg . |
| 606830 | 5/1978 | U.S.S.R. . |
| 939054 | 6/1982 | U.S.S.R. . |
| 1000090 | 2/1983 | U.S.S.R. . |
| 1364610 | 1/1988 | U.S.S.R. . |
| 1032608 | 6/1966 | United Kingdom . |

OTHER PUBLICATIONS

Patent Abstracts of Japan, vol. 2, No. 144 (CO29) Nov. 30, 1978 & JP.A.53 109 895, Sep 26, 1978.

*Primary Examiner*—John M. Husar
*Attorney, Agent, or Firm*—Cushman Darby & Cushman IP Group of Pillsbury Madison & Sutro LLP

[57] ABSTRACT

A molten melt of slag and grinding material is introduced into a mixing chamber to which a cooling and mixing agent is injected, the agent being compressed air, water or an air/water mixture which serves to cool the melt and form vapor and solidified particles. These are passed through a diffuser and are discharged as a jet which is directed to particle disintegrating means.

20 Claims, 1 Drawing Sheet

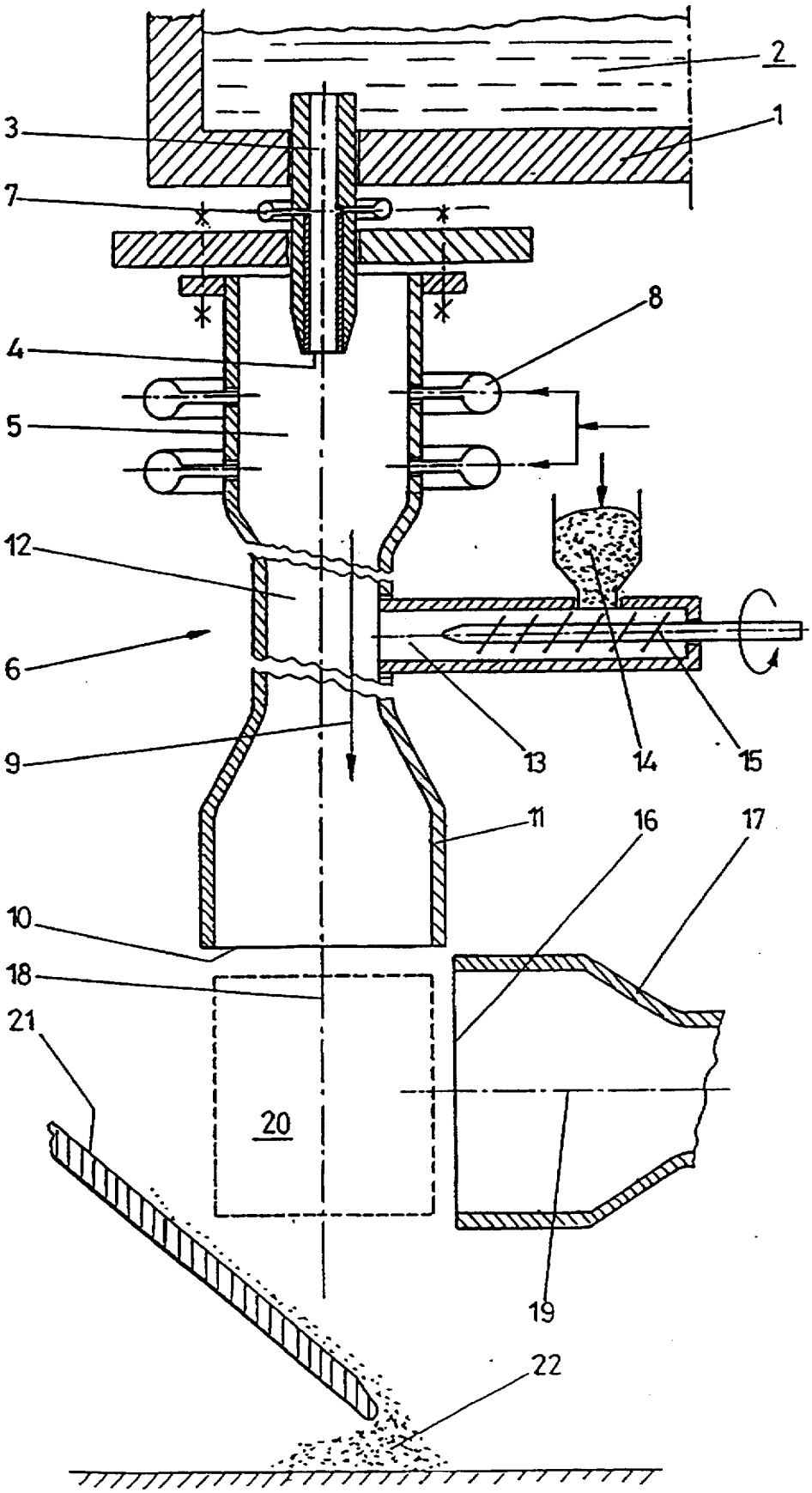
2
1
3
7
8
4
5
12
6
9
13
14
15
11
16
17
10
18
21
20
19
22

PROCESS AND DEVICE FOR GRANULATING AND CRUSHING MOLTEN MATERIALS AND GRINDING STOCKS

BACKGROUND OF THE INVENTION

1. Field of the Invention

The invention relates to a method of granulating and disintegrating molten material and grinding stock as well as to an arrangement for granulating and disintegrating blast furnace slag, clinker or the like, wherein molten slag is cooled with water under formation of a glass phase.

2. The Prior Art

Molten blast furnace slag, as a rule, is granulated by aid of water in order to obtain an amorphous product solidifying in the glass phase, i.e., a metastable phase. After a grinding procedure, such a product may be admixed to cements as a hydraulically active component. With such a mode of operation, the latent heat of the melt flow is converted into a low temperature heat of water and cannot be further utilized.

Also when cooling molten steel slags, the heat usually is cooled by ambient air via radiation and convection procedures. Waste heat of this kind cannot be readily utilized technologically, either.

On the whole, the latent heat of melt is extremely poorly utilized thermodynamically and technologically in all of the known granulation and cooling processes for slags, the originally contained energy substantially being used to store the originally contained energy in the form of the metastable glass phase of the end product and to prevent transformation into a stable crystalline state.

SUMMARY OF THE INVENTION

The invention aims at providing a method of the initially defined kind by which it is feasible to thermodynamically utilize the latent heat of slags in a substantially better way and to render energetically more favorable the grinding step usually required in case of further use as a cement aggregate or for pulverizing clinker for the production of cement. To solve this object, the method according to the invention essentially consists in that the melt is introduced into a mixing chamber by compressed air, that water, water vapor and/or air/water mixtures are injected into the mixing chamber through nozzles and that the evaporated water, together with the solidified slag, is expelled by means of a diffuser. By the fact that the melt is introduced into a mixing chamber by compressed air, and water, water vapor and/or air/water mixtures are nozzled into the mixing chamber, a rapidly expanding dispersion of solidifying molten material forms, the expanding gas stream being expelled through a diffuser. In doing so, the gas stream entrains the particles solidified to amorphous slag glass, while extremely increasing in volume with the thermal energy being converted into kinetic energy allowing for a directional flow of the granulated material formed. The pressure prevailing within the mixing chamber substantially corresponds to the flow losses of the strongly overheated water vapor formed. The slag heat primarily is converted into flow energy, the amorphous slag glass particles being entrained with the flow. As a result, the high kinetic energy can be applied directly to the disintegration of grain that is too large, to which end the method advantageously is realized in a manner that the jet emerging from the diffuser is directed against a baffle or a jet emerging from a further diffuser. Due to the collision with further particle streams streaming out at a high kinetic energy, or with a baffle, the kinetic energy is utilized so as to reduce the energy input required for the grinding procedure, a substantially farther-reaching utilization of the heat contained in the melt than has been feasible with known methods, thus, being ensured.

On account of the rapid increase in volume and the resulting expansion in the direction of the outlet opening of the vapor diffuser, a negative pressure can build up in the region of the maximum flow speed so as to render feasible, in that region, the dosing of additives by utilizing the effect of an injector. Advantageously, the method according to the invention is carried out in a manner that additional grinding stock or additives are introduced between the mixing chamber and the diffuser via an injector. Subsequently, the heterogenous fluid consisting of a mixture of water vapor and solid particles streams through the vapor diffuser, thus reducing the flow speed accordingly; in order to avoid uncontrolled further expansion behind the diffuser mouth, the method advantageously is realized in that the exit speed of the vapor jet from the diffuser is adjusted to be smaller than sonic speed.

The vapor formed within the scope of the method according to the invention exhibits a substantially higher temperature level as compared to conventional slag granulating arrangements, the vapor temperature being recoverable in a conventional manner. To this end, it is advantageously proceeded in that the vapor formed is drawn off and conducted through a heat exchanger and that the condensate is recycled to the mixing chamber such that also the used water can be guided in circulation.

The arrangement according to the invention essentially consists in that a duct for molten slag is connected with a mixing chamber, that ducts for water, water vapor and/or water/air mixtures run into the mixing chamber, that a diffuser is connected to the mixing chamber and that baffles or additional outlet openings for accelerated particles are provided at the outlet opening, whose axes cut the axis of the outlet opening of the diffuser. The formed blast furnace slag granulate by an arrangement of this kind not only can solidify in the amorphous glass phase but, at the same time, also can be disintegrated, under utilization of the kinetic energy formed from the thermal energy by conversion, to such an extent that a further grinding procedure may be omitted. Thus, the thermodynamic energy of the slag melt is instantly utilized also for the grinding procedure.

Advantageously, the arrangement according to the invention is further developed in a manner that the duct for molten slag runs into the mixing chamber via a blast connection comprising annular nozzles to which compressed air is fed, an enhanced dispersion thus being obtainable within the mixing chamber, which is designed as a granulation evaporator. The fine dispersion obtained by the feeding of compressed air allows for the provision of substantially simpler means for the introduction of compressed water or vapor, wherein the water jet, for instance, may be injected into the mixing chamber radially.

Advantageously, the configuration is realized such that an injector chamber having a smaller effective cross section than the outlet opening of the diffuser is arranged between the mixing chamber and the diffuser, to which injector chamber a duct for additional grinding stock or additives is connected so as to immediately enable the suction or dosed introduction of additives or additional grinding stock into the arrangement according to the invention under utilization of the injector effect.

To recover the sensible and latent heat of the vapor and to guide the water required for granulation in circulation, the arrangement advantageously is devised such that a vapor exhaustion means is arranged to follow the outlet opening of the diffuser and the vapor exhaustion duct is connected with at least one heat exchanger, whereupon the condensate can be recycled to the mixing chamber via a pump.

It is exactly the possibility on grounds of the high kinetic energy to carry out a grinding procedure within the arrangement according to the invention with the kinetic energy of the particles, which offers the particular advantage that possibly remaining oversize grains are recycled in circulation into the arrangement according to the invention for further disintegration. To this end, the injector effect already mentioned above may be utilized in an advantageous manner by advantageously devising the arrangement such that a sieving or screening means is arranged to follow the diffuser and that the sieve overflow or oversize grains can be recycled into the injection chamber via a conveying means.

BRIEF DESCRIPTION OF THE DRAWINGS

The invention will be explained in more detail by way of an exemplary embodiment schematically illustrated in the drawing.

DESCRIPTION OF THE PREFERRED EMBODIMENT

In the drawing, reference numeral 1 serves to denote a slag melting vessel, from which a slag melt 2 is drawn off through a tap opening 3. The tap opening 3, via an annular nozzle 4, runs into a mixing chamber 5 of the arrangement according to the invention for granulating and disintegrating the slag, which, as a whole, is denoted by 6. Through an externally arranged annular channel 7 compressed air is introduced into the annular nozzle 4, thus obtaining a homogenous dispersion of the slag jet within the mixing chamber 5. Furthermore, ducts 8 for compressed water run into the mixing chamber 5. The compressed water impelled into the mixing chamber 5 through ducts 8 expands at a high speed and is able to stream out in the direction of arrow 9. During this streaming-out procedure in the direction of arrow 9, the granulated particles are imparted flow energy such that the particle stream, together with the vapor, can leave the outlet opening 10 of a vapor diffuser 11 at a high rate and hence a high kinetic energy of the particles contained. On the way between the mixing chamber 5 and the vapor diffuser 11, a zone 12 of reduced cross section is provided, in which a negative pressure can form at a simultanously maximum flow rate such that additional grinding stock or aggregates or additives may be sucked in according to the injector principle through duct 13. For the dosed introduction of aggregates or additional grinding material, a storage bin 14 is provided and a dosing worm 15 is arranged in the supply channel leading to the injector chamber.

On the mouth end 10 of the vapor diffuser a further diffuser mouth 16 of a further vapor diffuser 17 is schematically indicated, upon which a further arrangement that is substantially equal to the arrangement 6 follows. The axes 18 and 19 of the particle streams leaving the diffusers 11 and 17, respectively, intersect in a granulate disintegrating section schematically indicated by 20, which causes the intensive conversion of kinetic energy into grinding energy, the particles thus being disintegrated further. The same purpose is served by a baffle plate 21, on which the particle streams impinge, optionally deflected by particles of the respective second unit, and are disintegrated under utilization of the residual kinetic energy still available.

The grinding stock denoted by 22 upon sieving may directly be used as a cement or cement aggregate, wherein oversize grains possibly still present may be recycled into the injector chamber 12 through duct 13.

I claim:

1. A method for granulating and disintegrating a molten melt of slag and grinding material, comprising the steps of:

introducing the melt into a mixing chamber under pressure;

injecting into said mixing chamber a cooling and mixing agent comprising at least one of compressed air, compressed water and a compressed air/water mixture to cool the melt and form a vapor and solidified particles;

passing the vapor and solidified particles from the mixing chamber through a diffuser to form a first discharge jet of vapor and particles; and directing the jet discharged from the diffuser to means for disintegrating the particles, said disintegrating means being selected from a group including: (a) an additional diffuser discharging a further jet of vapor and particles in a path which intersects said first discharge jet whereby particles in the respective jets collide and disintegrate; and (b) a baffle plate positioned to be impinged by particles carried by at least said first jet.

2. A method according to claim 1, comprising the further step of introducing aggregate material to the vapor and solidified particles during passage from the mixing chamber through the diffuser.

3. A method according to claim 2, wherein the discharge jet is less than sonic speed.

4. A method according to claim 1, comprising the further steps of:

drawing off vapor from the discharge jet and passing the vapor through a heat exchanger to form a condensate; and recycling the condensate for injection into the mixing chamber.

5. A method according to claim 4, comprising the further step of introducing aggregate material to the vapor and solidified particles during passage from the mixing chamber through the diffuser.

6. A method according to claim 5, wherein the discharge jet is less than sonic speed.

7. A method according to claim 4, wherein the discharge jet is less than sonic speed.

8. A method according to claim 1, wherein the discharge jet is less than sonic speed.

9. Apparatus for granulating and disintegrating a molten melt of slag and grinding material, comprising:

a mixing chamber:

means for introducing the melt into the mixing chamber under pressure;

means for injecting into said mixing chamber a cooling and mixing agent, comprising at least one of compressed air, compressed water and a compressed air/water mixture, for cooling the melt to form a vapor and solidified particles;

a diffuser joined to the mixing chamber for receiving the vapor and solidified particles from the mixing chamber and discharging them from the diffuser as a first jet of vapor and particles; and means for disintegrating the particles, said disintegrating means being selected from a group including: (a) an additional diffuser discharging a further jet of vapor and particles in a path which intersects said first discharge jet whereby particles in the respective jets collide and disintegrate; and (b) a baffle plate positioned to be impinged by particles carried by at least said first jet.

10. Apparatus according to claim 9, wherein the molten melt is contained in a vessel joined to the mixing chamber by a nozzle whereby the melt is introduced into said chamber by passage of the melt from said vessel through the nozzle, the apparatus further comprising:

means for injecting compressed air into said nozzle to mix with the melt introduced to the mixing chamber.

11. Apparatus according to claim 9 or 10, further comprising:

a conduit disposed between the mixing chamber and the diffuser for carrying the vapor and solidified particles from the mixing chamber to the diffuser, said conduit being dimensioned to create a pressure drop between the mixing chamber and the diffuser; and means joined to the conduit for introducing aggregate material to the vapor and solidified particles received by the diffuser.

12. Apparatus according to claim 11, further comprising:

means for drawing off vapor from the discharge jet and passing the vapor through a heat exchanger to form a condensate; and means for supplying the condensate to said injecting means.

13. Apparatus according to claim 11, wherein said disintegrating means comprises a baffle plate.

14. Apparatus according to claim 9 or 10, further comprising:

means for drawing off vapor from the discharge jet and passing the vapor through a heat exchanger to form a condensate; and means for supplying the condensate to said injecting means.

15. Apparatus according to claim 10, wherein said disintegrating means comprises a baffle plate.

16. Apparatus according to claim 10, further comprising:

an additional diffuser discharging a further jet of vapor and particles in a path which intersects that of the first-mentioned jet whereby particles in the respective paths collide and disintegrate.

17. Apparatus according to claim 16, wherein said disintegrating means further comprises a baffle plate positioned to be impinged by particles carried by each of said jets.

18. Apparatus according to claim 12, wherein said disintegrating means comprises a baffle plate.

19. Apparatus according to claim 14, wherein said disintegrating means comprises a baffle plate.

20. Apparatus according to claim 11, further comprising:

screening means positioned adjacent the particle disintegrating means for receiving disintegrated particles; and means for conveying disintegrated particles too large to pass through the screening means to the aggregate introducing means.

* * * * *